US007000560B2

(12) United States Patent
Wingett et al.

(10) Patent No.: US 7,000,560 B2
(45) Date of Patent: Feb. 21, 2006

(54) UNMANNED UNDERWATER VEHICLE DOCKING STATION COUPLING SYSTEM AND METHOD

(75) Inventors: Paul T. Wingett, Mesa, AZ (US); Sharon K. Brault, Chandler, AZ (US); Calvin C. Potter, Mesa, AZ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/880,935

(22) Filed: Jun. 29, 2004

(65) Prior Publication Data

US 2005/0279270 A1 Dec. 22, 2005

Related U.S. Application Data

(60) Provisional application No. 60/529,344, filed on Dec. 11, 2003.

(51) Int. Cl.
*B63G 8/41* (2006.01)

(52) U.S. Cl. ..... 114/322; 114/51

(58) Field of Classification Search ..... 114/20.1, 114/21.1, 50, 51, 312, 322, 328; 367/131, 367/133, 134; 340/850
See application file for complete search history.

(56) References Cited

U.S. PATENT DOCUMENTS

| | | | | |
|---|---|---|---|---|
| 4,010,619 | A * | 3/1977 | Hightower et al. | 114/322 |
| 4,502,407 | A * | 3/1985 | Stevens | 114/222 |
| 4,686,927 | A * | 8/1987 | Hawkes et al. | 114/312 |
| 5,235,932 | A | 8/1993 | Reich | |
| 5,579,285 | A | 11/1996 | Hubert | |
| 5,894,450 | A | 4/1999 | Schmidt et al. | |
| 6,167,831 | B1 | 1/2001 | Watt et al. | |
| 6,223,675 | B1 | 5/2001 | Watt et al. | |
| 6,390,012 | B1 * | 5/2002 | Watt et al. | 114/322 |
| 2002/0040783 | A1 | 4/2002 | Zimmerman et al. | |
| 2003/0167998 | A1 | 9/2003 | Huntsman | |
| 2003/0180096 | A1 | 9/2003 | Appleford et al. | |

* cited by examiner

*Primary Examiner*—Lars A. Olson
(74) *Attorney, Agent, or Firm*—Ingrassia Fisher & Lorenz

(57) ABSTRACT

A docking station for an unmanned underwater vehicle (UUV) includes a tether control system to minimize movement of the docking station when the UUV is docking therein. The docking station is a submerged station that is tethered to a floating structure via a tether line. The tether control system selectively loosens and tightens the tether line during UUV docking, to thereby minimize movement of the docking station during UUV docking operations.

24 Claims, 3 Drawing Sheets

UNMANNED UNDERWATER VEHICLE DOCKING STATION COUPLING SYSTEM AND METHOD

CROSS-REFERENCES TO RELATED APPLICATIONS

This application claims the benefit of U.S. Provisional Application No. 60/529,344 filed Dec. 11, 2003.

FIELD OF THE INVENTION

The present invention relates to unmanned underwater vehicles and, more particularly, to an unmanned underwater vehicle docking station coupling system and method.

BACKGROUND OF THE INVENTION

Unmanned underwater vehicles (UUVs) may be used to conduct various military and non-military operations. Such operations may include, for example, maritime reconnaissance, undersea searching, undersea surveying, submarine tracking and trailing, monitoring of various types of sea traffic, monitoring animal and plant life, and communication and/or navigational aids. These and other operational capabilities make UUVs a potential option in providing a seagoing component for homeland security. In a homeland security scenario, multiple UUVs could be deployed along the coasts of the country, and conduct various security-related monitoring and surveillance operations.

For most military and homeland security operations, it may be desirable that the UUVs remain submerged for relatively long periods of time. As such, many UUVs may include a propulsion plant that is powered by a power source that can generate a desired level of power while the UUV remains submerged, while at the same time generating a relatively low level of acoustic noise. Various types of power sources have been used and/or developed that meet one or more of these objectives. Some examples include batteries, and closed brayton cycles (CBCs) with rechargeable heat sources. Although batteries and rechargeable heat sources may be advantageous from a cost standpoint, both of these types of power sources may need periodic recharging.

In addition to the need to be periodically recharged or refueled, at some point during UUV operation, it may be desirable to retrieve various types of data from, and to supply various types of data to, the UUV. Such data can include stored intelligence data, data associated with equipment on-board the UUV, and data that updates UUV mission programming.

In many current UUVs, the need to periodically recharge, and/or retrieve data from, and/or supply data to, the UUV may require that the UUV be periodically retrieved, and taken out of service. In many instances, this results in the UUV being surfaced, and removed from the water, in order to conduct these operations. Moreover, some current UUVs may be periodically taken out of service to inspect on-board equipment to determine if maintenance should be conducted. In both instances, this can be a costly and time-consuming operation, and can reduce overall mission effectiveness.

To alleviate the need to remove the UUV from the water, submerged docking stations have been postulated. However, such docking stations may be anchored to, for example, one or more surface structures via a tether line. The surface structures may be subject to movement in response to, for example, surface waves or other surface craft. This movement may then be transmitted to the docking station via the tether line, which can make UUV docking procedures difficult, if not impossible.

Hence, there is a need for a system and method of coupling a UUV docking station to a surface structure that minimizes movement of the docking station at least during UUV docking procedures. The present invention addresses at least this need.

SUMMARY OF THE INVENTION

The present invention provides a system and method for coupling a submerged unmanned underwater vehicle (UUV) to a surface buoy or other structure and for controlling the coupling thereto during docking of a UUV therein.

In one embodiment, and by way of example only, a docking system for an unmanned underwater vehicle (UUV) includes a housing, a spool, a tether line, a lock control circuit, and a spool lock. The housing has one or more UUV docking ports formed therein that are configured to receive one or more UUVs. The spool is mounted within the housing and is movable in a deploy direction and a stow direction. The tether line is at least partially wound on the spool and is configured to couple to a structure that floats on a surface of a body of water, to thereby anchor the housing to the structure. The lock control circuit is configured to selectively supply one or more lock command signals. The spool lock is coupled to receive the lock command signals and is operable, in response thereto, to move between a locked position, in which the spool lock engages the spool and prevents rotation thereof, and an unlocked position, in which the spool lock disengages the spool and allows movement thereof in both the stow and deploy directions.

In another exemplary embodiment, a tether line control system for an unmanned underwater vehicle (UUV) docking station includes a spool, a tether line, a lock control circuit, and a spool lock. The spool is adapted to mount within the docking station and is movable in a deploy direction and a stow direction. The tether line is at least partially wound on the spool and is configured to couple to a structure that floats on the surface of the body of water, to thereby anchor the docking station to the structure. The lock control circuit is configured to selectively supply one or more lock command signals. The spool lock is coupled to receive the lock command signals and is operable, in response thereto, to move between a locked position, in which the spool lock engages the spool and prevents movement thereof, and an unlocked position, in which the spool lock disengages the spool and allows movement thereof in both the stow and deploy directions.

In yet another exemplary embodiment, a method of operating a submerged docking station for an unmanned underwater vehicle (UUV) includes coupling the docking station to a surface buoy via a tether line, and selectively loosening and tightening the tether line during the docking of the UUV.

Other independent features and advantages of the preferred docking station coupling system and method will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
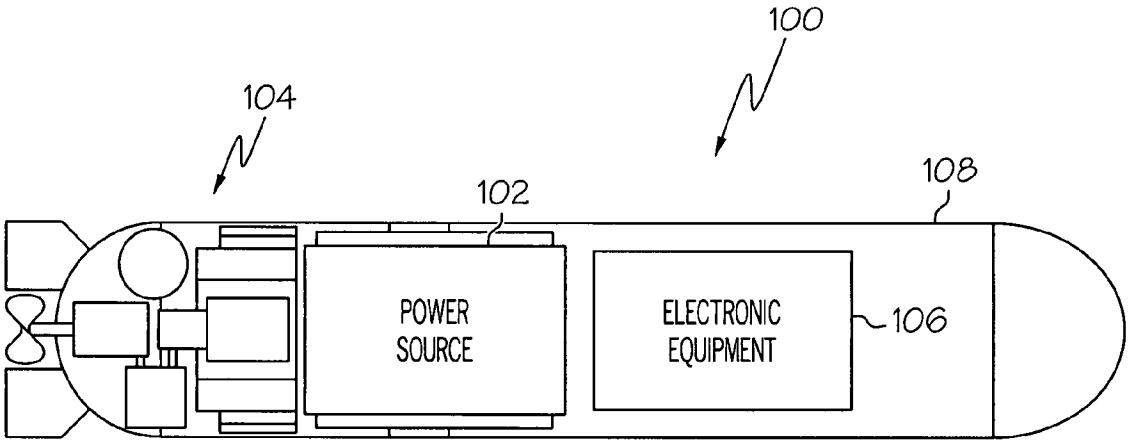
FIG. 1 is a simplified functional block diagram representation of an exemplary unmanned underwater vehicle (UUV)

An exemplary embodiment of an unmanned underwater vehicle (UUV) 100 is shown in FIG. 1, and includes a power source 102, a power plant 104, and on-board electronic equipment 106, all housed within a hull 108. The power source 102 is a rechargeable power source and is used to supply power to the power plant 104. The power source 102 may be any one of numerous types of rechargeable power sources such as, for example, a rechargeable heat source for driving a closed Brayton cycle (CBC), and/or a battery. If a rechargeable heat source is used, it may be any one of numerous types of rechargeable heat sources such as, for example, a porous solid or a molten salt. Similarly, if a battery is used, it may be any one of numerous types of rechargeable batteries such as, for example, a lead-acid battery, a nickel-cadmium battery, or a lithium battery.

The power plant 104 uses the power supplied from the power source 102 to generate propulsion power and electrical power for the UUV 100. Thus, the power plant 104 preferably includes one or more turbines, generators, and/or motors to supply the needed propulsion and electrical power. It will be appreciated that the particular number, type, and configuration of equipment and components used to implement the power plant 104 may vary depending on the specific power source 102 that is used.

The on-board electronic equipment 106 may also vary, depending on the purpose and mission of the UUV 100, the configuration of the power source 102, and/or the configuration of the power plant 104. No matter the particular type of on-board electronic equipment 106 that is used, or its particular configuration, the on-board electronic equipment 106 is preferably configured to gather and store data regarding various equipment and systems on-board the UUV 100, including the power source 102 and power plant 104, as well as data associated with the mission of the UUV 100. The on-board electronic equipment 106 is also preferably configured to transmit some or all of the data it gathers and stores to, and/or to receive various types of data from, a remote station (not illustrated). The on-board electronic equipment 106 also preferably includes one or more sensors and recorders, or other devices, for providing various health monitoring functions. Moreover, and as will be described in more detail further below, the on-board electronic equipment 106 is also preferably configured to transmit one or more signals indicating that it is ready to dock in a docking station.

Figure 2:
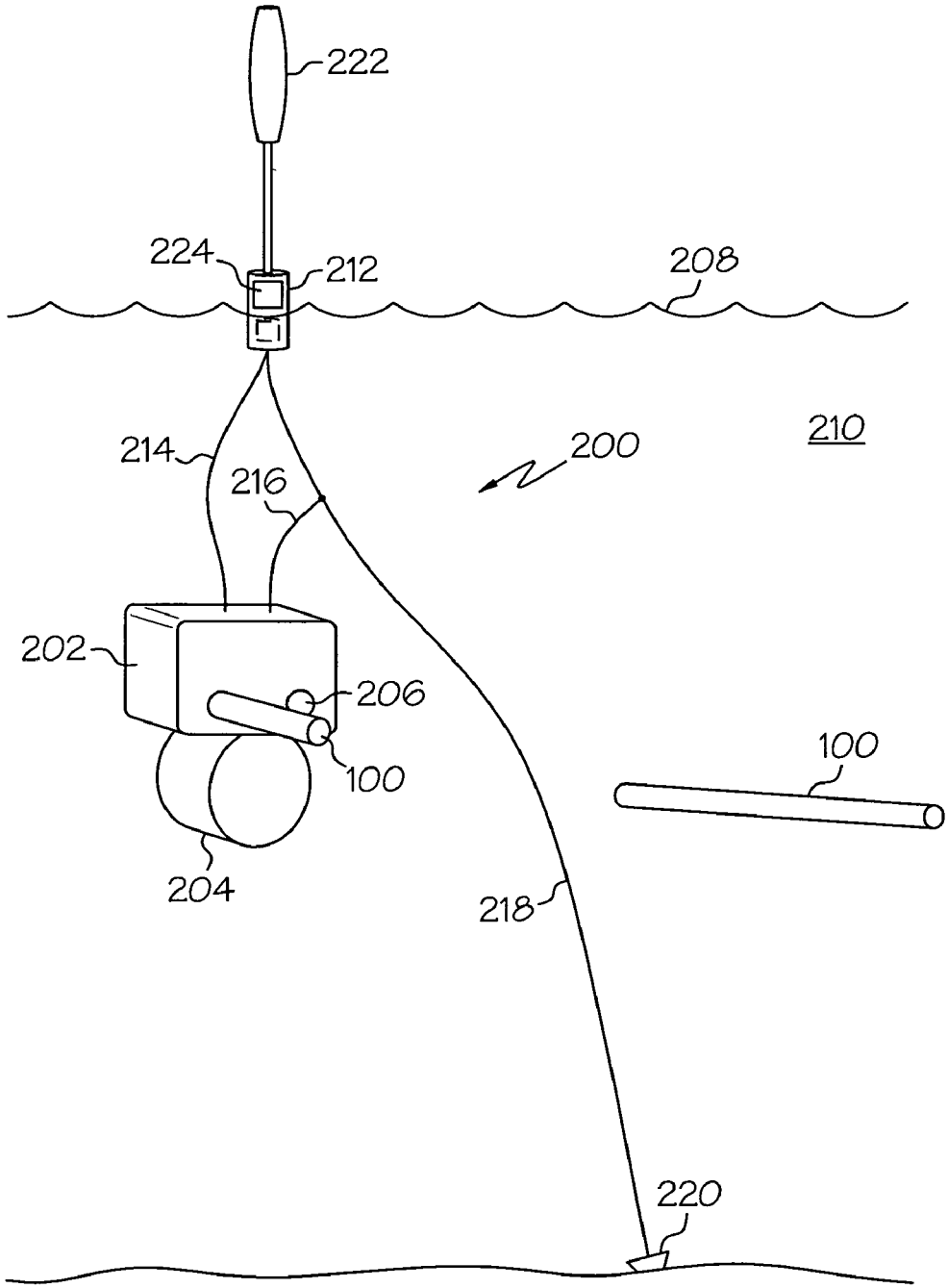
FIG. 2 is a simplified perspective view of an exemplary UUV docking station that may be used to dock one or more UUVs, such as the exemplary UUV shown in FIG. 1.

The UUV power source 102 can be recharged, and data can be transferred to/from the on-board electronic equipment 106, whenever the UUV 100 is docked in a docking station. An exemplary embodiment of a docking station 200 is illustrated in FIG. 2, and includes a housing 202, one or more buoyancy tanks 204, and one or more docking ports 206. When deployed, the docking station 200 is preferably submerged below the surface 208 of the body of water 210 in which it is placed, and is tethered to a surface buoy 212 via a plurality of tether lines 214, 216. As will be described in more detail further below, one or both of the tether lines 214, 216 is wound on a tether spool (not shown in FIG. 2). The tether lines 214, 216 may be any one of numerous types of tether lines. In the depicted embodiment, one of the tether lines 214 preferably includes one or more sets of conductors for transmitting data between the surface buoy 212 and the docking station 200, and one or more conduits for supplying air and/or fuel to the docking station 200. The remaining tether line 216 is coupled to a surface buoy anchor line 218. The surface buoy anchor line 218 is coupled between the surface buoy and an anchor 220, which maintains the position of the surface buoy 212.

The surface buoy 212 may be an existing surface buoy 212 or may be specifically designed to interface with the docking station 200. In either case, the surface buoy 212 preferably includes one or more antennae 222 for transmitting data to and receiving data from the previously-mentioned remote station. The surface buoy 212 also preferably includes one or more transceivers 224 configured to transmit data to and receive data from the non-illustrated remote station. The transceivers 224, or separate transceivers, are also preferably configured to transmit data to and receive data from the on-board electronic equipment 106 in a docked UUV 100.

The buoyancy tank 204 is coupled to the docking station housing 202 and, in the depicted embodiment, is disposed external to the housing 202. It will be appreciated that the docking station 200 could include more than one buoyancy tank 204, and that the one or more buoyancy tanks 204 could be disposed either within or external to the housing 202. The buoyancy tank 204 maintains the housing 202 at a predetermined depth below the surface 208 of the water 210, and maintains a substantially constant tension on the tether lines 214, 216. The buoyancy tanks could include various types of fluid including, for example, fuel that may be used to refuel docked UUVs 100.

The docking ports 206 are disposed within the docking station housing 202 and are each configured to receive, and dock, a single UUV 100 therein. In the depicted embodiment, the housing 202 is configured to include two docking ports 206; however, it will be appreciated that this is merely exemplary, and that the housing 202 could be configured to include more or less than this number of docking ports 206. Moreover, although the docking ports 206 are shown as being configured to receive and dock a single UUV 100 therein, it will be appreciated that one or more of the docking ports 206 could be configured to receive and dock more than one UUV 100. It will be appreciated that the surface buoy 212 also preferably includes one or more air and/or fuel connections, which are used to service the submerged docking station 200 via the tether line 214.

Figure 3:
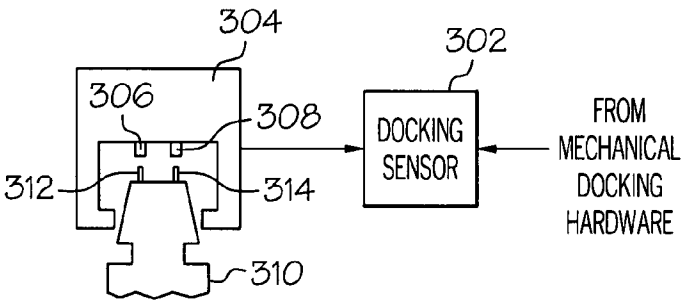
FIG. 3 is a simplified schematic representation illustrating exemplary mechanical and electrical interconnections between the UUV docking station and a UUV.

No matter the particular number of docking ports 206, or the particular number of UUVs 100 each docking port 206 can receive and dock, it will be appreciated that each docking port 206 includes hardware sufficient to mechanically capture a UUV 100, and to electrically couple to portions of the UUV 100. A simplified representation of a portion of this hardware 300 is shown in FIG. 3, and includes a docking sensor 302, and a docking connector 304.

The docking sensor 302 is configured to sense when the UUV 100 is properly docked in the docking port 206 and is ready to be recharged. As will be described more fully below, the docking sensor 302 supplies an appropriate sensor signal to equipment within the docking station 200 indicating that the UUV 100 is properly docked, both mechanically and electrically.

The docking connector 304 includes data port 306 and a power port 308. When the UUV 100 is properly docked within a docking port 206, the docking connector 304 is couple to a UUV connector 310, which also includes a data port 312 and a power port 314. The docking connector data port 306 and UUV connector data port 312 are configured to electrically couple together, as are the docking connector power port 308 and the UUV connector power port 314. The data connector ports 306, 312 are used to transmit data from, and/or supply data to, the on-board electronic equipment 106, and the power ports 308, 314 are used to supply electrical power to recharge the power source 102. It will be appreciated that if the power source 102 is a rechargeable heat source, the electrical power is supplied to one or more induction heater coils (not illustrated) to reheat (e.g., recharge) the heat source. The electrical power that is used to recharge the UUV power source 102 is supplied from a charging system that preferably forms part of the docking station 200.

Figure 4:
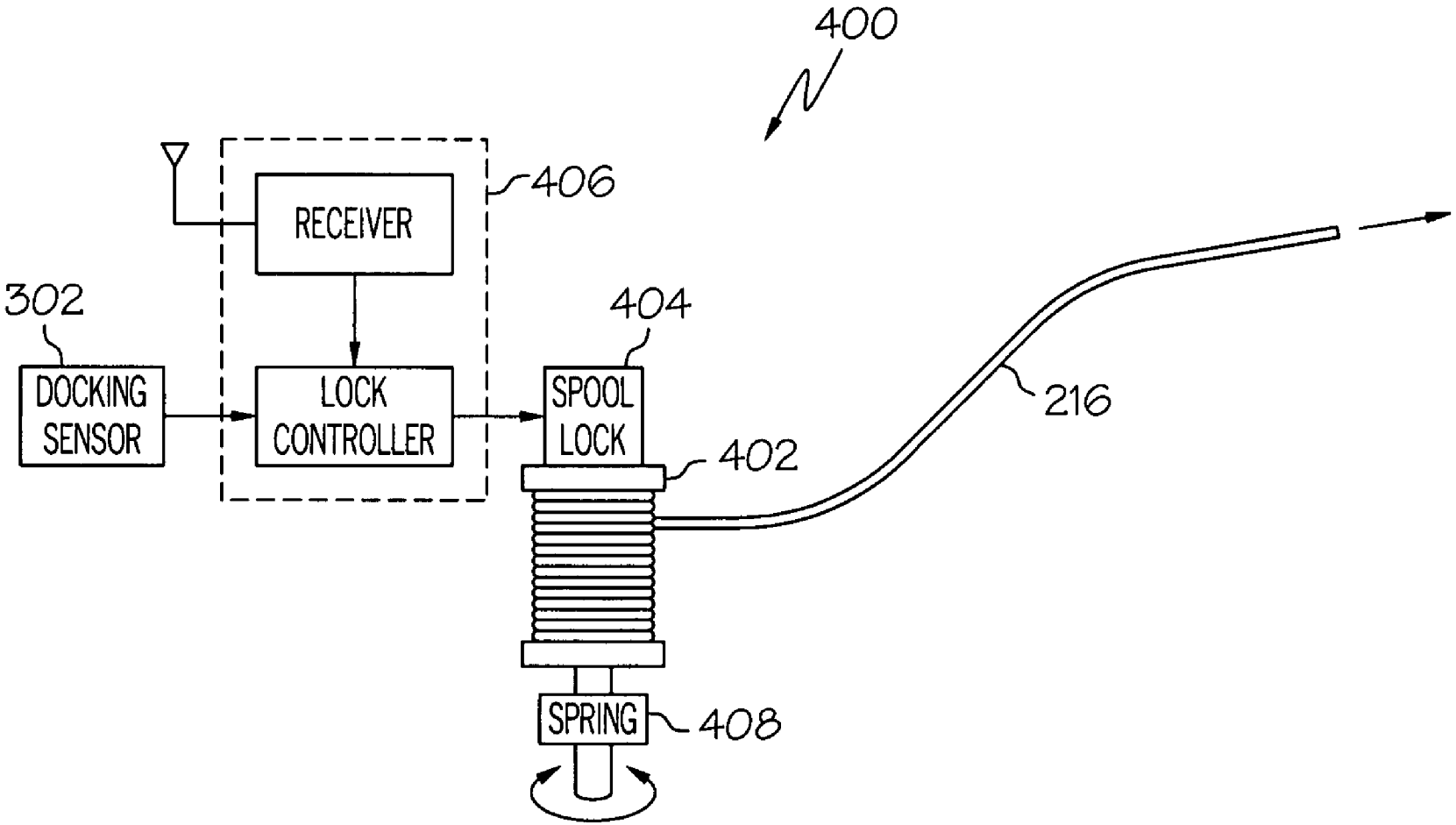
FIG. 4 is a functional block diagram of an exemplary UUV tether line control system that may be used to couple the exemplary UUV docking station of FIG. 2 to a surface buoy and control the coupling thereof.

The docking station 200, as was noted above, is used to facilitate recharge of the UUV power source 102 and/or data transfer to/from the on-board electronics 106. In order to do so, the UUV 100 is first docked in the docking station 200. As was previously mentioned, when the UUV 100 is being docked in the docking station 200, it is preferable to minimize docking station movement. Such movement may occur as a result of disturbances either on, or below, the surface 208 of the body of water, or as a result of the docking sequence itself. Thus, the docking station 200 includes a tether line control system to help minimize this movement. A functional block diagram of an exemplary tether line control system is shown in FIG. 4, and will now be described.

The tether line control system 400 includes a tether spool 402, a spool lock 404, and a lock controller 406. The tether spool 402 is movably mounted in the docking station housing 202 and has either or both of the tether lines 214, 216 wound thereon. In the depicted embodiment, only one of the tether lines 216 is wound on the tether spool 402. It will additionally be appreciated that the tether control system 400 could include two tether spools 402, with each tether line 214, 216 being individually wound on one of the two tether spools 402.

No matter the particular number of tether spools 402 included, each is moveable in both a deploy direction and a stow direction. When the tether spool 402 moves in the deploy direction, the tether line(s) 216 (214, 216) will be unwound from the tether spool 402, deploying more tether line(s) 216 (214, 216) from the housing 202. Conversely, when the tether spool 402 moves in the stow direction, the tether line(s) 216 (214, 216) will be wound onto the tether spool 402. In the depicted embodiment, a bias spring 408 is coupled to the tether spool 402. The bias spring 408, which may be any one of numerous types of spring elements, supplies a bias force to the tether spool 402 in the stow direction. The purpose for this will be described in more detail further below.

The spool lock 404 is coupled to the tether spool 402 and is moveable between a locked and an unlocked position. In the locked position, the spool lock 404 engages the tether spool 402 and prevents its movement in at least the deploy direction. That is, the spool lock 404, when in the locked position, may be configured to allow the tether spool 402 to move in the stow direction, but not the deploy direction. When the spool lock 404 is in the unlocked position, it disengages the tether spool 402, and the tether spool 402 is free to move in either the stow direction or the deploy direction. As will be described in more detail further below, the spool lock 404 is normally kept in the locked position, and is moved to the unlocked position just prior to, and when, a UUV 100 is docking in the docking station 200. The spool lock 404 may be any one of numerous types of locks now known or developed in the future that is operable to respond to one or more lock commands supplied from the lock controller 406.

The lock control circuit 406, as was just noted, is used to control the position of the spool lock 404. In the depicted embodiment, the lock controller 406 includes a receiver 410 and a lock control circuit 412. The receiver 410 is configured to receive one or more signals from the UUV 100 and, in response to the received signals, to supply one or more signals to the lock control circuit 412. More specifically, the UUV 100 is preferably configured to transmit one or more signals to the docking station 200 indicating that the UUV 100 is ready to dock. The UUV 100 may additionally be configured to transmit one or more docking signals to the docking station 200 indicating that the UUV is properly docked. Conversely, or in addition to the docking signals supplied from the UUV 100, and as FIG. 4 additionally shows, the docking sensor 302 may supply the docking signals to the lock control circuit 412 when the UUV 100 is properly docked.

The lock control circuit 412, in response to the signals supplied from the receiver 410 and/or the docking sensor 302, supplies the lock command signals to the spool lock 404. The lock command signals supplied by the lock control circuit 412 may vary, depending on the particular type of spool lock 404 that is used. For example, the lock command signals could be signals having a particular non-zero voltage magnitude, or having a zero voltage magnitude, depending, for example, on whether the spool lock 404 moves to it locked or unlocked position in response to being energized or de-energized. Although the receiver 410 and lock control circuit 412 are shown as being part of the lock controller 406, it will be appreciated that the receiver 410 could be part of a separate system and/or circuit within the UUV 100.

When the UUV 100 needs to be docked to, for example, recharge the power source 102, transfer data to/from the electronic equipment, or both, the UUV 100 transmits an appropriate signal to the docking station 200 indicating that it is ready to dock. This signal is received by at least the receiver 410, which in turn supplies an appropriate signal to the lock control circuit 412. Upon receipt of the signal from the receiver 410, the lock control circuit 412 supplies one or more lock command signals to the spool lock 404. The spool lock 404, in response to the lock command signals, moves to the unlocked position, disengaging the tether spool 402.

The bias spring 408, as was noted above, supplies a bias force to the tether spool 402 in the stow direction. The magnitude of the bias force supplied by the bias spring 408 is such that it will allow the tether spool 402 to move relatively easily in the deploy direction, if necessary, but at the same time will not overly tighten the tether line(s) 216 (214, 216). Thus, if the state of the body of water 210 is such that it is causing the surface buoy 212 to move around, the docking station 200 will not be concomitantly moved. This is because even though the movement of the surface buoy 212 is transmitted to the tether line(s) 216 (214, 216), the unlocked tether spool 402 will deploy some slack, as needed, in the tether line(s) 216 (214, 216) to inhibit similar movement of the docking station 200. The deployed slack will then be taken up by the bias force of the bias spring 408.

Once the UUV 100 is docked in the docking station 200, the lock control circuit 406 will receive a UUV docking signal from either, or both, the UUV 100 or the docking sensor 302. The lock control circuit 406 will in turn supply one or more appropriate lock command signals to the spool lock 404, causing the spool lock 404 to move to the locked position, thereby engaging the tether spool 402. As was previously noted, the spool lock 404 is in the locked position, it may continue to allow the tether spool 402 to move in the stow direction. The spool lock 404 may be so configured in order to allow extra slack to be taken up if such slack exists in the tether line(s) 216 (214, 216) once the UUV 100 is fully docked in the docking station 200.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A docking system for an unmanned underwater vehicle (UUV), comprising:

a housing having one or more UUV docking ports formed therein, the UUV docking ports configured to receive one or more UUVs;

a spool mounted within the housing and movable in a deploy direction and a stow direction;

a tether line at least partially wound on the spool and configured to couple to a structure that floats on a surface of a body of water, to thereby anchor the housing to the structure;

a lock control circuit configured to selectively supply one or more lock command signals; and a spool lock coupled to receive the lock command signals and operable, in response thereto, to move between (i) a locked position, in which the spool lock engages the spool and prevents movement thereof in at least the deploy direction, and (ii) an unlocked position, in which the spool lock disengages the spool and allows movement thereof in both the stow and deploy directions.

2. The docking system of claim 1, further comprising:

a buoyancy tank coupled to the housing and configured to maintain the housing at a zero buoyancy when submerged to a predetermined depth below the surface of the body of water.

3. The docking system of claim 1, further comprising:

a spring coupled to the spool and configured to supply a bias force to the spool in the stow direction.

4. The docking system of claim 1, wherein the lock control circuit is adapted to receive one or more signals from the UUV and is operable, in response thereto, to selectively supply the one or more lock command signals.

5. The docking system of claim 4, wherein the lock control circuit is adapted to receive one or more signals indicating that the UUV is ready to dock in the docking station and is operable, in response hereto, to supply one or more lock command signals that cause the spool lock to move from the locked to the unlocked position.

6. The docking system of claim 5, further comprising:

a receiver circuit coupled to the lock control circuit, the receiver adapted to receive one or more signals from the UUV and operable, in response thereto, to supply the signals to the lock control circuit indicating that the UUV is ready to dock.

7. The docking system of claim 1, wherein the controller is adapted to receive a UUV docking signal indicating that the UUV is properly docked in the docking station and is operable, in response thereto, to supply one or more lock command signals that cause the spool lock to move from the unlocked to the locked position.

8. The docking system of claim 7, further comprising:

a docking sensor configured to sense when the UUV is properly docked in the docking station and operable, in response thereto, to supply the UUV docking signal to at least the spool lock controller.

9. The docking system of claim 1, wherein the tether line includes one or more data transmission conductors extending therethrough.

10. The docking system of claim 1, wherein the tether line includes one or more fluid conduits extending therethrough.

11. A tether line control system for an unmanned underwater vehicle (UUV) docking station, comprising:

a spool adapted to mount within the docking station and movable in a deploy direction and a stow direction;

a tether line at least partially wound on the spool and configured to couple to a structure that floats on the surface of the body of water, to thereby anchor the docking station to the structure;

a lock control circuit configured to selectively supply one or more lock command signals; and a spool lock coupled to receive the lock command signals and operable, in response thereto, to move between (i) a locked position, in which the spool lock engages the spool and prevents movement thereof in at least the deploy direction, and (ii) an unlocked position, in which the spool lock disengages the spool and allows movement thereof in both the stow and deploy directions.

12. The system of claim 11, further comprising:

a spring coupled to the spool and configured to supply a bias force to the spool in the stow direction.

13. The system of claim 11, wherein the lock control circuit is adapted to receive one or more signals from a UUV and is operable, in response thereto, to selectively supply the one or more lock command signals.

14. The system of claim 13, wherein the lock control circuit is adapted to receive one or more signals indicating that the UUV is ready to dock in the docking station and is operable, in response thereto, to supply one or more lock command signals that cause the spool lock to move from the locked to the unlocked position.

15. The system of claim 14, further comprising:

a receiver circuit coupled to the lock control circuit, the receiver adapted to receive one or more signals from the UUV and operable, in response thereto, to supply the signals to the lock control circuit indicating that the UUV is ready to dock.

16. The system of claim 11, wherein the lock control circuit is adapted to receive a UUV docking signal indicating that the UUV is properly docked in the docking station and is operable, in response thereto, to supply one or more lock command signals that cause the spool lock to move from the unlocked to the locked position.

17. The system of claim 16, further comprising:

a docking sensor configured to sense when the UUV is properly docked in the docking station and operable, in response thereto, to supply the UUV docking signal to at least the lock control circuit.

18. The system of claim 11, wherein the tether line includes one or more data transmission conductors extending therethrough.

19. The system of claim 11, wherein the tether line includes one or more fluid conduits extending therethrough.

20. A method of operating a submerged docking station for an unmanned underwater vehicle (UUV), comprising the steps of:

coupling the docking station to a surface buoy via a tether line;

determining a docking status of the UUV; and selectively loosening and tightening the tether line during the docking of the UUV and in response to the determined docking status.

21. The method of claim 20, further comprising:

maintaining a substantially constant tension on the tether line before and after the UUV is docked in the docking station.

22. The method of claim 20, further comprising:

maintaining the docking station at a predetermined depth below a surface of a body of water.

23. The method of claim 22, further comprising:

coupling one or more buoyancy tanks to the docking station to thereby maintain the docking station at the predetermined depth.

24. The method of claim 20, wherein the docking status includes a prepared to dock status and a docked status.

* * * * *

UNITED STATES PATENT AND TRADEMARK OFFICE

CERTIFICATE OF CORRECTION

PATENT NO. : 7,000,560 B2
APPLICATION NO. : 10/880935
DATED : February 21, 2006
INVENTOR(S) : Paul T. Wingett, Sharon K. Brault and Calvin C. Potter It is certified that error appears in the above-identified patent and that said Letters Patent is hereby corrected as shown below:

In Column 8, line 2, delete “hereto” and add --thereto--.

Signed and Sealed this

Sixth Day of November, 2007

JON W. DUDAS
*Director of the United States Patent and Trademark Office*